United States Patent [19]

Swanson

[11] Patent Number: 4,692,577

[45] Date of Patent: Sep. 8, 1987

[54] SWITCH FOR A HIGH-VOLTAGE INTERRUPTING MODULE

[75] Inventor: Roy T. Swanson, North Riverside, Ill.

[73] Assignee: S&C Electric Company, Chicago, Ill.

[21] Appl. No.: 791,178

[22] Filed: Oct. 25, 1985

[51] Int. Cl.[4] ..... H01H 33/06

[52] U.S. Cl. ..... 200/151; 200/82 B

[58] Field of Search ..... 200/151, 82 B

[56] References Cited

U.S. PATENT DOCUMENTS

| | | | |
|---|---|---|---|
| 2,277,422 | 3/1942 | Walle | 200/151 |
| 2,477,837 | 8/1949 | Strom | 200/151 |
| 3,129,307 | 4/1964 | De Vargas | 200/151 |
| 3,281,561 | 10/1966 | Marx et al. | 200/151 |
| 4,342,978 | 8/1982 | Meister | 337/6 |
| 4,370,531 | 1/1983 | Tobin | 200/151 |
| 4,460,886 | 7/1984 | Jarosz et al. | 337/148 |
| 4,467,307 | 8/1984 | Jackson | 337/30 |
| 4,490,707 | 12/1984 | O'Leary | 337/6 |
| 4,494,103 | 1/1985 | Jarosz et al. | 337/282 |
| 4,499,446 | 2/1985 | Swanson | 337/30 |

*Primary Examiner*—Robert S. Macon

*Attorney, Agent, or Firm*—James V. Lapacek

[57] ABSTRACT

An energy-absorbing element is provided between an insulative piston and a movable contact of a switch for a high-voltage device. In arrangements where a fusible element is in electrical shunt with the switch, the energy-absorbing element improves the rapid commutation of the current from the switch to the fusible element where final circuit interruption takes place. The switch is of the general type in which ignition of a power cartridge moves the insulative piston, which is normally located in a bore formed in a conductive member, away therefrom and into a passageway formed in an insulative liner. The movement of the piston moves the movable contact through the passageway and away from the conductive member to break an electrical interconnection between the conductive member and the movable contact. This forms a gap between the conductive member and the movable contact and opens the switch. The ignition of the power cartridge evolves high pressure within a chamber defined by the piston and the bore. This high pressure acts against the piston and the resulting forces rapidly drive the piston; the movable contact being driven via the transmission of forces through the energy-absorbing element. The energy-absorbing element enhances the rapid and simultaneous movement of the piston and the movable contact. The energy-absorbing element absorbs sufficient energy at the interface between the piston and the movable contact to prevent undesirable reaction effects which may be caused by the reaction or rebounding forces between the piston and the movable contact.

8 Claims, 2 Drawing Figures

SWITCH FOR A HIGH-VOLTAGE INTERRUPTING MODULE

BACKGROUND OF THE INVENTION

1. Field of the Invention

The present invention relates to an improved switch for a high-voltage interrupting module wherein the capabilities are improved to transfer current from a main current path to a current-limiting shunt path. The present invention is an improvement over the switches disclosed and claimed in commonly assigned U.S. Pat. Nos.: 4,342,978; 4,370,531; 4,490,707; 4,494,103; 4,460,886; 4,467,307; and 4,499,446.

2. Description of the Related Art

The aforementioned patents relate to various aspects of a pressure-operated switch and to a high-voltage interrupting module containing the switch. The switch may include a pair of contacts, which are normally electrically interconnected, for example, by direct abutment therebetween or, preferably, by interconnecting them with a shearable or tearable metallic disc or membrane. In preferred embodiments of the switch, one contact is stationary, while the other is movable, although both may be movable. The contacts are separable by relative movement apart along a fixed line of direction to open a gap therebetween, thereby opening the switch. One of the contacts, preferably the stationary contact, contains a bore which, in conjunction with a piston or trailer positioned between the movable contact and the bore, defines a closed chamber. The chamber houses a power cartridge or similar pressure-generating device.

The switch may be in electrical shunt with a fusible element; the switch and the fusible element preferably residing within a common housing. When the switch is closed (i.e., when the contacts thereof are electrically interconnected), the impedance of the current path through the switch is much lower than the impedance of the current path through the fusible element, and, accordingly, a negligible portion of the current flowing through the module flows through the fusible element. The switch is designed to carry much higher currents than the fusible element. Thus, the module has a very high continuous current rating. Separation of the contacts is achieved by igniting the power cartridge, which generates a high pressure within the chamber. The power cartridge in this type of switch may be ignited in response to a trip signal produced by apparatus which senses a fault current or other over-current in a circit in which the interrupting module is connected for protection thereof. Suitable trip-signal-producing apparatus is disclosed in commonly assigned U.S. application Ser. Nos. 506,942 filed on June 22, 1983, 658,239 filed on Oct. 3, 1984, and 791,195 filed on Oct. 25, 1985, all in the name of J. W. Ruta. The high pressure that is evolved by the ignition of the power cartridge acts against the piston and the forces produced thereby rapidly drive the piston and the movable contact away from the stationary contact, which shears the disc to break the normal electrical interconnection and open the switch. Upon opening the switch, the contacts separate and current is rapidly commutated from the switch to the fusible element where it is interrupted. The switch is required to transfer or commutate high currents from the main current path of the switch to the fusible element. Specifically, the maximum instantaneous current that the switch can rapidly transfer into the fusible element can be a limiting factor regarding the maximum interrupting capability of the interrupting module and the capability to interrupt high-frequency currents. For higher voltage ratings or other purposes, as the length of the fusible element is increased and the length of the switch, and therefore, its mass is also increased, the rapid transfer of current to the fusible element is exacerbated due to an increase in the impedance of the fusible element and the delay in moving the mass of the movable portion of the switch. Accordingly, because the pressure in the chamber is applied to one end of the piston in a very short time, e.g. several hundred microseconds, at this rate of rise of pressure, the time for the force to travel through the piston to operate the movable contact becomes an appreciable factor. Various dynamic-reaction and rebounding effects can occur between the piston and the movable contact, some of which detract from the desired objective to move the piston and the movable contact rapidly and simultaneously along the same path to rapidly open the switch and transfer current to the fusible element.

In specific embodiments of the switch and associated apparatus described in the above patents and patent applications, a second stationary contact is included. While the switch is closed, the movable contact and the second stationary contact are electrically interconnected with a second shearable disc. When the power cartridge is ignited, movement of the movable contact also shears the second disc. As the movable contact moves away from the first stationary contact, it is telescoped into a bore formed in the second stationary contact. This bore may be lined with an insulative sleeve and the movable contact may be covered with an insulative sleeve, so that such telescoping results in the formation of a second gap between the movable contact and the second stationary contact.

The movable contact moves rapidly away from the first stationary contact through a passageway in an insulative liner, which the piston may also enter. The piston also enters the passageway in the liner to compress and extinguish the arc that forms between the moving contact and the first stationary contact. In preferred embodiments of the switch, the stationary contacts and the liner are engageably surrounded, and have their relative positions fixed, by an insulative housing, which maintains the stationary contacts and the liner end-to-end with the bores and the passageway being axially aligned.

SUMMARY OF THE INVENTION

Accordingly, it is a principal object of the present invention to provide an improved switch for a high-voltage interrupting module including improved capability to rapidly transfer current from a main current path to a current-limiting shunt path by the provision of an energy absorbing element between a movable insulative piston and a movable contact; movement of the piston and the movable contact opening the main current path when the piston is acted upon by pressurized gas at the end of the piston opposite the interface to the energy absorbing element.

It is another object of the present invention to provide an improved pressure-operated switch including an energy-absorbing element disposed between a movable contact and an insulative piston for enhancing the rapid movement of the piston and the movable contact while maintaining the intimate contact at the interfaces between the piston, the energy-absorbing element and the movable contact; the piston being acted upon by high pressure at the end opposite the energy absorbing element, the energy-absorbing element being arc-extinguishing material in arrangements where additional deionizing of an arc is desired during opening of the switch.

These and other objects of the present invention are achieved by provision of an energy-absorbing element between an insulative piston and a movable contact of a switch for a high-voltage device. In arrangements where a fusible element is in electrical shunt with the switch, the energy-absorbing element improves the rapid commutation of the current from the switch to the fusible element where final circuit interruption takes place. The switch is of the general type in which ignition of a power cartridge moves the insulative piston, which is normally located in a bore formed in a conductive member, away therefrom and into a passageway formed in an insulative liner. The movement of the piston moves the movable contact through the passageway and away from the conductive member to break an electrical interconnection between the conductive member and the movable contact. This forms a gap between the conductive member and the movable contact and opens the switch. The ignition of the power cartridge evolves high pressure within a chamber defined by the piston and the bore. This high pressure acts against the piston and the resulting forces rapidly drive the piston; the movable contact being driven via the transmission of forces through the energy-absorbing element. The energy-absorbing element enhances the rapid and simultaneous movement of the piston and the movable contact. The energy-absorbing element absorbs sufficient energy at the interface between the piston and the movable contact to prevent rebounding between the piston and the movable contact.

In one arrangement, the energy-absorbing element is formed as a cake or cylindrical solid from a suitable material providing interstices in the cake. During switch-opening operation, the high pressures transmitted through the piston crush the cake into a powdered state; the crushing action suitably absorbing energy to prevent undesirable dynamic interaction and rebounding between the piston and the movable contact. Further, the buffering interface provided by the energy-absorbing element prevents the formation of gaps between the piston, the energy-absorbing element and the movable contact. Any such gaps would delay the transfer of current to the fusible element and thereby lead to excessive contamination of the switch gap by the arc that forms between the movable contact and the conductive member. In a specific arrangement, the material of the energy-absorbing element is selected to provide arc-extinguishing properties. In specific embodiments, the energy-absorbing element is fabricated from boric acid or polytetrafluoroethylene. Accordingly, the arc-extinguishing material aids in the interruption of current in the main current section of the switch as the energy-absorbing element is crushed and at least some of the material is distributed and dispersed along the interfaces of the various portions of the switch.

DETAILED DESCRIPTION

Figure 1:
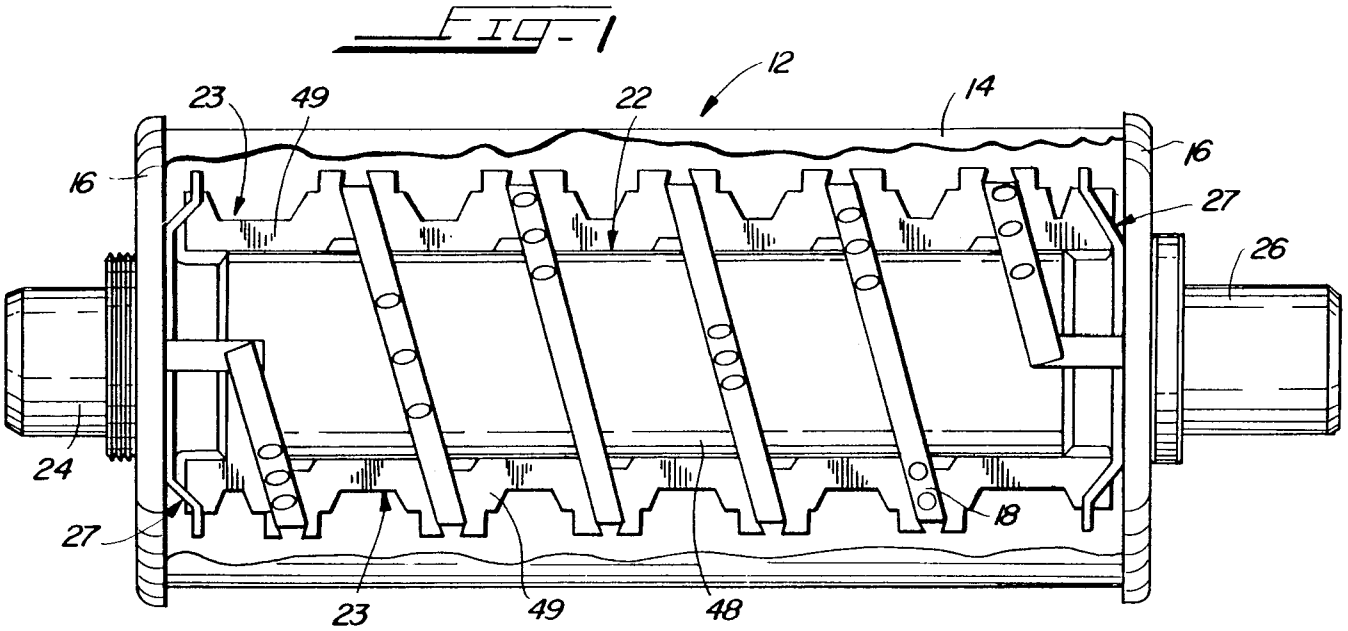
FIG. 1 is a front elevation of a portion of an interrupting module which includes an improved switch according to the present invention.

Referring to FIG. 1, the switch 22 of the present invention is for use as part of a module 12. The module 12 includes a generally cylindrical open-ended insulative housing 14, which is closed by end plates 16. The housing and end plates 14 and 16 surround a fusible element 18 helically wound around a central axis of the housing 14 and may also surround a mass 20 of a particulate fulgurite-forming medium, such as silica sand. The silica sand is in intimate engagement with one or more fusible elements 18. The fusible element 18, which may be silver, copper, or the like and the sand 20 interrupt fault currents or other over-currents therethrough in a current-limiting or energy-limiting manner, according to well-known principles. The fusible element 18 may be similar to those disclosed in U.S. Pat. Nos. 4,359,708 and 4,481,495. The housing 14 also surrounds the switch 22 around which the fusible element 18 may be maintained in its helical configuration by insulative supports 23.

Figure 2:
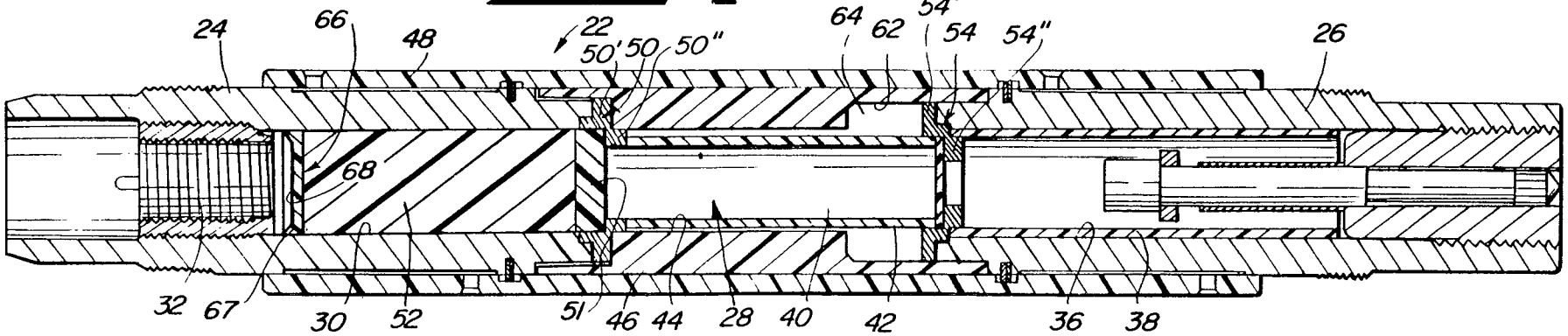
FIG. 2 is a partially sectioned front elevation of a portion of FIG. 1 which shows in greater detail the improved switch hereof in the closed position.

The switch 22, which is improved by the present invention, may be generally constructed in accordance with the aforemetnioned U.S. Pat. Nos.: 4,342,978; 4,370,531; 4,490,707; 4,494,103; 4,460,886; 4,467,307; and 4,499,446. Referring now to FIG. 2, the switch 22 includes a first conductive member 24, to which the left end plate 16 is attached, and a second conductive member 26 to which the right end plate 16 is attached. The first conductive member 24 serves as a first stationary contact of the switch 22, while the second conductive member 26 serves as a second stationary contact of the switch 22. The ends of the fusible element 18 may be rendered electrically continuous with the stationary contacts 24 and 26 by facilities 27 described more fully in U.S. Pat. No. 4,491,820 The switch 22 also includes a movable contact 28. Normally, the movable contact 28 is electrically continuous with both stationary contacts 24 and 26 so that a continuous low-impedance electrical path is formed between the members 24 and 26 via the movable contact 28. Because the impedance of this path is lower than the impedance of the fusible element 18, while the switch 22 is closed, as depicted in FIG. 2, all but a negligible portion of the current flowing through the module 12 is normally shunted through the switch 22 which is designed to carry much higher currents than the fusible element and away from the fusible element 18. When the switch 22 opens, as described below, the current formerly flowing through the stationary contacts 24 and 26 and the movable contact 28 is commutated to the fusible element 18 for interruption.

The first stationary contact 24 has a central bore 30. At the left end of the central bore 30, a power cartridge 32 or other pressure-generating device is located. The second stationary contact 26 also contains a central bore 36. This bore 36 may be lined with an insulative sleeve 38. The movable contact 28 comprises a conductive member 40 surrounded by an insulative sleeve 42. The movable contact 28 is normally located between the stationary contacts 24 and 26 and within a passageway 44 formed through an insulative liner 46 between the stationary contacts 24 and 26.

The stationary contacts 24 and 26 with the liner 46 are held with the bores 30 and 36 and the passageway 44 aligned therebetween by an insulative housing 48 which engageably surrounds the stationary contacts 24 and 26 which are affixed thereto in a convenient manner. If desired, the linear 46 may overlap the stationary contacts 24 and 26 in accordance with the invention disclosed in commonly assigned U.S. application Ser. No. 525,516 filed Aug. 22, 1983 in the name of R. T. Swanson. As shown in FIG. 1, the insulative support 23 may comprise notched fins 49, and the fusible element 18 may be helically maintained about the housing 48 by the fins 49. With the movable contact 28 occupying the position shown in FIG. 2, the conductive member 40 thereof is electrically interconnected to the stationary contact 24 by a conductive shear disc 50 or other metallic diaphragm or member, which is shearable, tearable or the like. To the left of the diaphragm 50 is located an insulative piston 52. In the normal position of the movable contact 28 shown in FIG. 2, the piston 52 normally occupies the bore 30 in the first stationary contact 24 and the movable contact 28 occupies the passageway 44 in the liner 46.

In accordance with important aspects of the present invention, an energy-absorbing member or element 51 is disposed between the piston 52 and the movable contact 28. It is also preferred that the material used for the energy-absorbing element 51 have excellent arc-extinguishing properties. The energy-absorbing element 51 has a thickness that is defined in accordance with the material from which the element 51 is fabricated, in accordance with its diameter, and in accordance with the amount of energy that must be absorbed to prevent rebounding or the formation of gaps between the piston 52, the energy-absorbing element 51, and the movable contact 28. The right end of the conductive member 40 is normally electrically interconnected to the second stationary contact 26 by a shear disc 54, which may be similar to the shear disc 50. The interior of the insulative sleeve 38 is sufficiently large to receive the conductive member 40 with its insulative sleeve 42 thereon. The passageway 44 of the liner 46 is suitably dimensioned to receive the conductive member 40 with the insulative sleeve 42 thereon and the piston 52. In preferred embodiments, the bores 30 and 36, the passageway 44, the movable contact 28, the piston 52, the energy-absorbing element 51, and the interior of the sleeve 38 all have circular cross-sections.

In the normal condition of the module 12, as shown in FIG. 2 and as previously described, the switch 22 carries a majority of the current flowing in a protected high-voltage circuit (not shown) to which the module 12 is connected. This current flows through the stationary contacts 24 and 26, the discs 50 and 54, and the movable contact 28. Little current normally flows through the fusible element 18. Should a fault current or other over-current occur in the protected circuit (not shown to which the module 12 is connected, apparatus (not shown) detects this condition and ignites the power cartridge 32. Ignition of the power cartridge 32 causes it to evolve high-pressure gas which acts on the left end of the piston 52. The force applied to the piston 52 by the high pressure moves the piston 52 rightwardly. Additionally, the movable contact 28 including the conductive member 40 and the insulative sleeve 42 also moves rightwardly via the transmission of force through the energy-absorbing element 51. Rightward movement of the piston 52 and the movable contact 28 severs, rips or tears the discs 50 and 54, thereby breaking the electrical interconnection between the movable contact 28 and both stationary contacts 24 and 26 as shown in FIG. 3 of U.S. Pat. No. 4,467,307. The shearing of each of the discs 50 and 54 produces two portions 50',50'' and two portions 54',54'' respectively. Two gaps are thereby opened by the switch 22. The first gap exists between the left end of the conductive member 40 and the right end of the first stationary contact 24, while the second gap exists between the right end of the conductive member 40 and the left end of the second stationary contact 26. Both gaps are electrically insulated. Specifically, the first gap is electrically insulated by the reception of the piston 52 within the passageway 44 in the liner 46. The second gap is electrically insulated by the reception of the insulative sleeve 42 within the bore 36 of the insulative sleeve 38. The reception of the piston 52 by the passageway 44 in the liner 46 is intended to compress and extinguish the arc that forms between the movable contact 28 and the stationary contact 24. In a preferred arrangement, a lip seal 66 is provided at the end of the piston 52 proximal to the power cartridge 32. The lip seal 66 comprises an insulative body 67 containing a blind bore 68 formed in the end of the body 67 proximal to the power cartridge 32. Preferably, the sidewall of the blind bore 68 is flared so that pressure-produced forces acting thereon tend to deform or flare the exterior of the body 67 outwardly. As set forth more fully in U.S. Pat. No. 4,499,446, it has been found that the pressure produced by the power cartridge 32 urges the exterior of the body 67 into sealing engagement with the bore 30. This lessens the flow of ignition products past the lip seal 66 as the piston 52 and the lip seal 66 move rightwardly. When the switch 22 opens, the current previously flowing therethrough is commutated to the fusible element 18. The action of the fusible element 18 and of the silica sand 20 (FIG. 1) ultimately extinguishes this current, as is well known.

While the pressure that is generated during opening exhibits a rapid rate of rise in a very short time (e.g. several hundred microseconds), the time for the force to travel through the piston 52 to the right end thereof becomes an appreciable factor. Without the provision of the energy-absorbing element 51, various dynamic-reaction or rebounding effects can occur between the piston and the movable contact, some of which may detract from the desired objective to move the piston 52 and the movable contact 28 rapidly and simultaneously to rapidly open the switch 22. For example, without the energy-absorbing element 51, it is believed that at applicable rates to rise of pressure, forces transmitted through a rigid piston 52 fabricated from a plastic such as polymethylpentene can cause rebounding at the interface between the piston 52 and the movable contact 28. Accordingly, the movable contact 28 may at certain times move faster than the piston 52. As a result, the piston 52 is separated from the movable contact so as to require a small, but possibly significant, time interval to catch up to the movable contact 28. Additionally, due to reaction forces, it is even possible for the piston 52 to be moving away from the movable contact 28 as the movable contact 28 moves rightwardly. These reaction effects can detract from the performance of the switch 22. For example, as soon as the movable contact begins to move rightwardly, the gap of the switch 22 can become excessively contaminated by arc products if the piston 52 does not move along with the movable contact 28. Concerning the module 12 of FIG. 1, the switch 22 is required to commutate high currents from the main current path of the switch 22 to the fusible element 18. Specifically, the maximum instantaneous current that the switch 22 can rapidly transfer to the fusible element 18 can be a limiting factor regarding the maximum interrupting capability of the module 12 and the capability to interrupt high frequency currents. For example, the high currents must be transferred to the fusible element 18 before interruption can occur. Any excessive delay in the transfer time will cause the fusible element 18 to melt before the transfer of current from the switch 22 to the fusible element 18 is complete. While arc voltage builds up as soon as the movable contact 28 begins to move so as to begin to transfer current to the fusible element 18, the transfer of current from the main current path of the switch 22 to the fusible element 18 is enhanced by the piston 52 entering the passageway 44 in the liner 46. In summary, any delay in the movement of the piston 52 reduces or detracts from the ability of the switch 22 to rapidly transfer current to the fusible element 18. Additionally, any time interval during which the piston 52 does not move along with the movable contact 28 can cause excessive contamination of the gap of the switch 22 by the arc that forms between the movable contact and the stationary contact 26 which can further reduce the ability of the switch 22 to transfer current to the fusible element 18. Of course, the magnitude of any dynamic reaction to cause the aforementioned condition depends on the properties and dimension of the associated parts.

In accordance with the present invention, the energy-absorbing element 51 absorbs sufficient energy at the interface between the piston 52 and the movable contact 28 to prevent rebounding caused by the transmission of forces between the piston 52 and the movable contact 28. The energy-absorbing element 51 functions as a buffer between the piston 52 and the movable contact 28.

In one arrangement, the energy-absorbing element 51 is formed as a cake or cylindrical solid from a suitable material providing interstices in the cake. During switch-opening operation, the high pressures transmitted through the piston crush the cake into a powdered state; the crushing action suitably absorbing energy to prevent undesirable dynamic interaction and rebounding between the piston and the movable contact. Further, the buffering interface provided by the energy-absorbing element 51 prevents the formation of gaps between the piston 52, the energy-absorbing element 51, and the movable contact 28. Any such gaps would delay the transfer of current to the fusible element and thereby lead to excessive contamination of the switch gap by arc products. Further, such arc products reduce the dielectric strength of the switch; a sufficient dielectric strength being required to withstand the current-limiting arc voltage that is developed across the switch upon melting of the fusible element 18. In a specific arrangement, the material of the energy-absorbing element 51 is selected to provide arc-extinguishing properties. In specific embodiments, the energy-absorbing element is fabricated form boric acid or polytetrafluoroethylene. Accordingly, the arc-extinguishing material aids in the interruption of current in the main current section of the switch 22 as the energy-absorbing element 51 is crushed and at least some of the material is distributed and dispersed along the interfaces of the various portions of the switch.

While the energy-absorbing element 51 as described hereinbefore is entirely suitable for a variety of applications of the switch, the aforementioned description is intended in the form of specific exemplary arrangements and should not be interpreted in any limiting sense. Accordingly, it should also be realized that other materials and configurations for the energy-absorbing element 51 are also possible other than as providing a crushing mechanism. For example, other materials for the energy-absorbing element 51 are also suitable for the objective of the present invention which is to provide the absorbing of energy.

While there have been illustrated and described various embodiments of the present invention, it will be apparent that various changes and modifications will occur to those skilled in the art. It is intended in the appendedd claims to cover all such changes and modifications as fall within the true spirit and scope of the present invention.

What is claimed and desired to be secured by Letter Patent of the United States is:

1. An improved switch for a high-voltage device; the switch being of the type in which an insulative piston is arranged to be moved at high speeds from its normally located position in a more formed in a conductive member, away from the bore and into a passageway formed in an insulative liner, such movement of the piston moving a movable contact through the passageway and away from the conductive member to break an electrical interconnection between the conductive member and the movable contact and to form a gap therebetween, thereby opening the switch; the bore and the passageway being aligned; wherein the improvement comprises the provision of energy-absorbing means for inhibiting rebounding of the piston from the movable contact, said energy-absorbing means comprising an element disposed between the piston and the movable contact, said element including interstices and being crushed in response to forces transmitted from the piston to the movable contact.

2. The improved switch of claim 1, wherein said element is fabricated so as to be crushed to a powdered form in response to forces transmitted from the piston to the movable contact.

3. The improved switch of claim 1, wherein the bore, the passageway, the piston, the energy-absorbing means, and the movable contact have the same shaped cross-sections.

4. The improved switch of claim 1 wherein said energy-absorbing means comprises boric acid.

5. The improved switch of claim 1 wherein said energy-absorbing means is fabricated from polytetrafluoroethylene.

6. The improved switch of claim 1 further comprising a second conductive member having a bore, a fusible element electrically connected in shunt across the conductive member and the second conductive member, the movable contact comprising a third conductive member surrounded by an insulative sleeve, in a closed state of the switch the movable contact being electrically connected between the conductive member and the second conductive member, the bore of the second conductive member also being aligned with the passageway of the insulative liner, the movable contact entering the bore of the second conductive member to provide electrical opening of the switch.

7. The improved switch of claim 6 wherein said energy-absorbing means aids in the rapid transfer of current to the fusible element by absorbing energy upon opening of the switch to reduce rebounding at the interface between the piston and the movable contact.

8. The improved switch of claim 1 wherein said energy-absorbing means comprises arc-extinguishing material.

* * * * *

UNITED STATES PATENT AND TRADEMARK OFFICE

CERTIFICATE OF CORRECTION

PATENT NO. : 4,692,577

DATED : Sep. 8, 1987

INVENTOR(S) : Roy T. Swanson

It is certified that error appears in the above-identified patent and that said Letters Patent is hereby corrected as shown below:

Col. 1, line 51, "circit" should be -- circuit --.

Col. 5, line 3, "linear" should be -- liner --.

Col. 5, line 55, after "shown" insert -- ) -- (ending parenthetical).

Col. 6, line 48, "to" should be -- of --.

Col. 8, line 19, "more" should be -- bore --.

Signed and Sealed this

Ninth Day of February, 1988

*Attest:*

DONALD J. QUIGG

*Attesting Officer*

*Commissioner of Patents and Trademarks*